US008235752B2

(12) United States Patent
Nakamura

(10) Patent No.: US 8,235,752 B2
(45) Date of Patent: Aug. 7, 2012

(54) CONNECTOR

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 41 days.

(21) Appl. No.: 12/967,090

(22) Filed: Dec. 14, 2010

(65) Prior Publication Data

US 2011/0143566 A1 Jun. 16, 2011

(30) Foreign Application Priority Data

Dec. 16, 2009 (JP) ..... 2009-285080

(51) Int. Cl.
*H01R 13/40* (2006.01)

(52) U.S. Cl. ..... 439/587

(58) Field of Classification Search ..... 439/587–589, 439/936, 274, 275
See application file for complete search history.

(56) References Cited

U.S. PATENT DOCUMENTS 5,618,206 A * 4/1997 Sawada et al. ..... 439/587
5,667,406 A * 9/1997 Tabata et al. ..... 439/587
5,927,725 A * 7/1999 Tabata et al. ..... 277/607
6,254,431 B1 * 7/2001 Murakami et al. ..... 439/587
6,257,928 B1 * 7/2001 Murakami et al. ..... 439/587
6,325,669 B1 * 12/2001 Safai ..... 439/587
6,582,242 B2 * 6/2003 Murakami et al. ..... 439/271

FOREIGN PATENT DOCUMENTS

JP 2009-093896 4/2009

* cited by examiner

*Primary Examiner* — Tulsidas C Patel
*Assistant Examiner* — Phuongchi Nguyen
(74) *Attorney, Agent, or Firm* — Gerald E. Hespos; Michael J. Porco

(57) ABSTRACT

A connector has an inner housing with a cavity for housing a terminal fitting, an outer housing assembled displaceably to the inner housing and a rubber plug. The rubber plug has a sealing portion, a vibration reducing portion and a vibration absorbing portion. The sealing portion is mounted fixedly on a rear end portion of the terminal fitting and is brought into close contact with an inner peripheral surface of the cavity. The vibration reducing portion is fit in a holding hole formed in the outer housing and thus is displaced with the outer housing. The vibration absorbing portion has a smaller thickness than the vibration reducing portion and connects the sealing portion to the vibration reducing portion. The vibration absorbing portion is outside the holding hole and in front of the holding hole.

11 Claims, 8 Drawing Sheets

CONNECTOR

BACKGROUND OF THE INVENTION

1. Field of the Invention

The invention relates to a connector.

2. Description of the Related Art

JP-A-2009-093896 discloses a connector with a housing that has a terminal holding member. The terminal holding member has a cavity in which a terminal fitting is housed. An electric wire is connected to the terminal fitting and is led out to a position behind the terminal holding member. A vibration attenuating member is assembled to the terminal holding member and is displaceable relative to the terminal holding member in a direction that interests the longitudinal direction of the wire. The vibration attenuating member has a holding hole behind the cavity and the electric wire penetrates through the holding hole. A cylindrical rubber plug is fit on the electric wire and has a sealing portion that is mounted fixedly on a rear end portion of the terminal fitting. The rubber plug is brought hermetically into close contact with an inner peripheral surface of the cavity. A vibration reducing portion is fit in the holding hole, and a vibration absorbing portion connects the sealing portion to the vibration reducing portion and has a smaller wall thickness than either the vibration reducing portion or the sealing portion.

The vibration reducing portion of the rubber plug is fit on the electric wire and the vibration attenuating member holds the vibration reducing portion. Thus, the vibration reducing portion and the vibration attenuating member displace integrally when the electric wire vibrates. Part of the vibration energy of the electric wire is absorbed as kinetic energy for displacing the vibration reducing portion and the vibration attenuating member. Hence, the vibrations that are transmitted to the terminal fitting from the electric wire by way of the rubber plug are attenuated. Further, part of the attenuated vibrations is absorbed by the vibration absorbing portion when the attenuated vibrations are transmitted from the vibration reducing portion to the sealing portion and hence, the vibrations transmitted to the terminal fitting can be attenuated effectively. Accordingly, a fine sliding wear at a contact between the terminal fitting and a counterpart terminal is suppressed.

The vibration reducing portion, the vibration absorbing portion and a rear end of the sealing portion are arranged in the holding hole of the vibration attenuating member in the above-mentioned connector. Accordingly, the rear end of the sealing portion can vibrate along with the displacement of the vibration absorbing portion and the vibration attenuating member for attenuating vibrations. Thus, the vibration absorbing portion may not be able to exhibit a sufficient vibration absorbing function.

The invention has been made in view of the circumstances described above, and an object of the invention is to provide a connector that more effectively can attenuate the transmission of vibrations to a terminal fitting from an electric wire.

SUMMARY OF THE INVENTION

The invention relates to a connector that has a housing, a terminal fitting mounted on the housing and a rubber plug mounted on the housing. The housing comprises a terminal holding member with for receiving the terminal fitting. An electric wire is fixed to the terminal fitting and is led out to a position behind the cavity. A vibration attenuating member is assembled to the terminal holding member and is displaceable relative to the terminal holding member in a direction that intersects a longitudinal direction of the electric wire. The vibration attenuating member has a holding hole arranged behind the cavity and the electric wire can pass through the holding hole. The rubber plug has a cylindrical shape and is fit on the electric wire. The rubber plug has an integral body with a sealing portion that is mounted fixedly on a rear end portion of the terminal fitting and is brought hermetically into close contact with an inner peripheral surface of the cavity. A vibration reducing portion is fit into the holding hole, and thus is integrally displaceable with the vibration attenuating member. A vibration absorbing portion connects a rear end of the sealing portion and a front end of the vibration reducing portion and is thinner than the vibration reducing portion. The vibration absorbing portion is outside the holding hole and in front of the holding hole.

The electric wire may vibrate. However, the vibration energy of the wire is attenuated due to the integral displacement of the vibration reducing portion and the vibration attenuating member. Part of the attenuated vibration is absorbed by the vibration absorbing portion when the vibrations are transmitted from the vibration reducing portion to the sealing portion. The vibration absorbing portion is outside the holding hole and in front of the holding hole. As a result, the vibration absorbing portion does not directly contact the vibration attenuating member and displacement of the vibration attenuating member is not transmitted directly to the sealing portion. Accordingly, the vibration absorbing portion exhibits a sufficient vibration absorbing function and vibrations transmitted from the electric wire to the terminal fitting are attenuated more effectively.

At least part of the vibration absorbing portion may be in the cavity. Thus, foreign matter will not interfere with the vibration absorbing portion and will not intrude into a gap between the terminal holding member and the vibration attenuating member.

The outer diameter of the vibration absorbing portion may be smaller than an outer diameter of the sealing portion so that the vibration absorbing portion does not contact an inner peripheral surface of the cavity.

The vibration absorbing portion absorbs vibrations by elastic deformation, but is not in contact with the inner peripheral surface of the cavity. Hence, the vibration absorbing portion exhibits a high vibration absorbing function.

The vibration absorbing portion may have a bellows shape to deform elastically and to exhibit a high vibration absorbing function.

Restrictions may be formed on an inner periphery of the holding hole and an outer periphery of the vibration reducing portion to restrict longitudinal displacement of the vibration reducing portion relative to the holding hole by concave-convex fitting. Thus, it is possible to surely position the holding hole and the vibration reducing portion.

DETAILED DESCRIPTION OF THE PREFERRED EMBODIMENT

Figure 1:
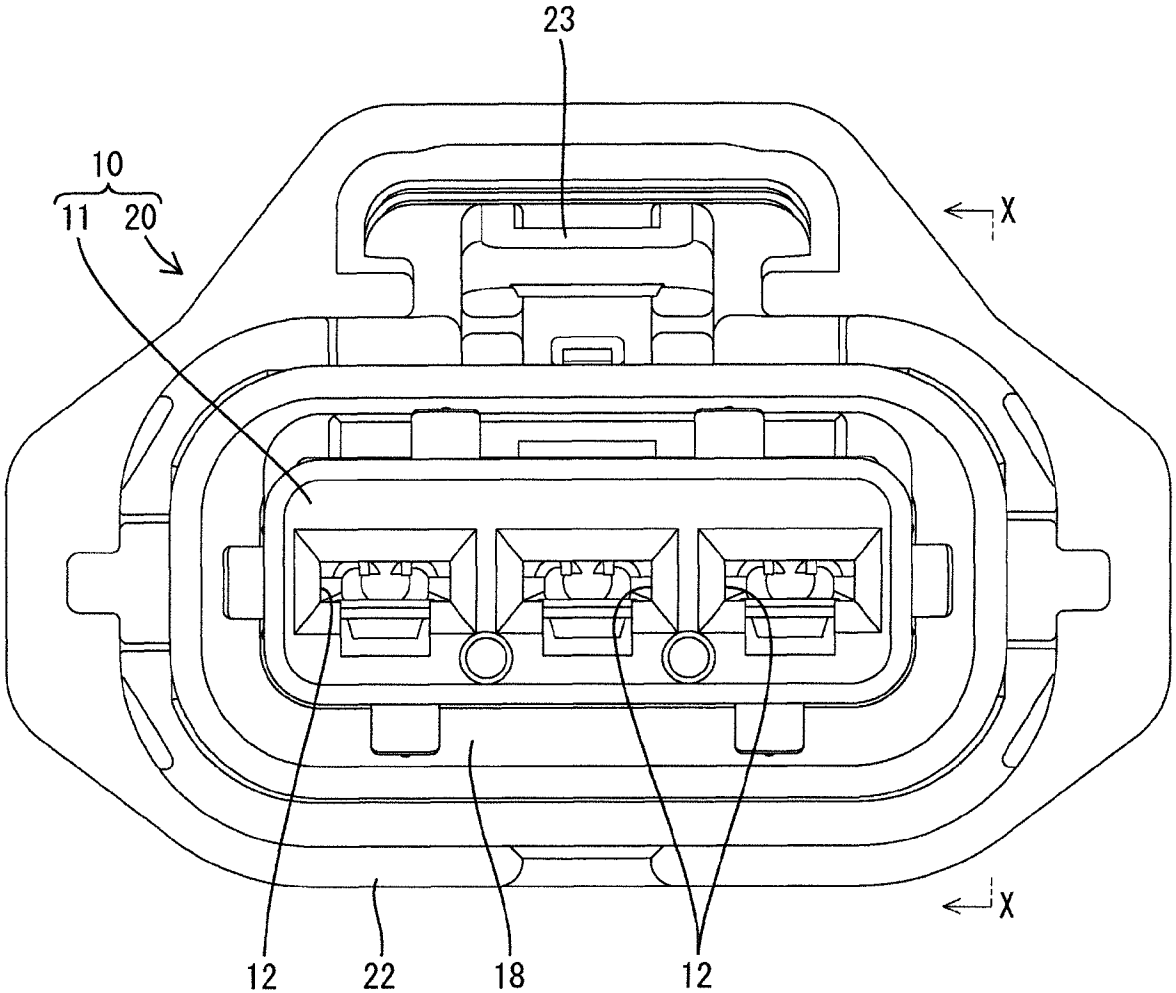
FIG. 1 a front view of a connector according to an embodiment 1.
Figure 2:
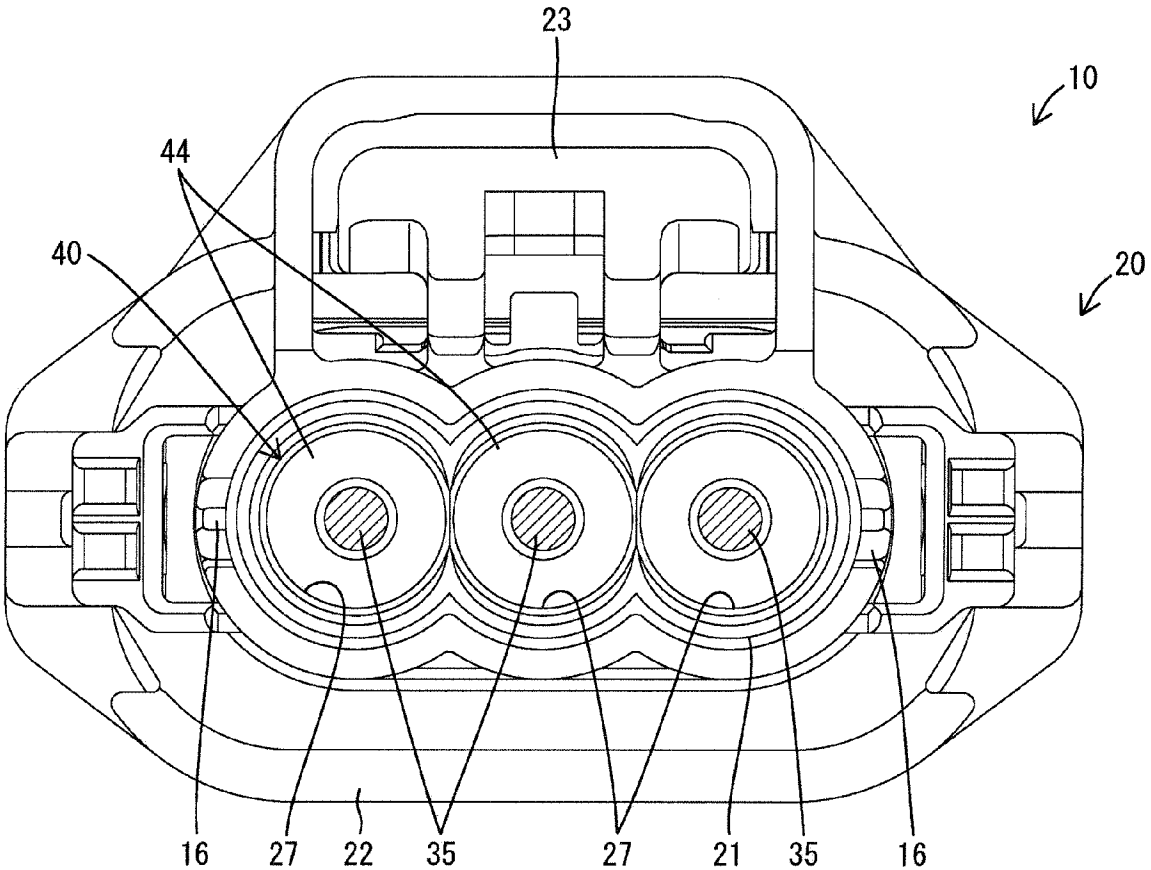
FIG. 2 is a back view of the connector.

A connector according to the invention has a housing identified by the numeral 10 in FIGS. 1 to 5. The housing 10 includes a block shaped inner housing 11 that functions as a terminal holding member and an outer housing 20 that functions as a vibration attenuating member. The inner and outer housings 11 and 20 are made of synthetic resin in this embodiment. The connector also includes terminal fittings 30 and rubber plugs 40 that are inserted into the housing 10.

Cavities 12 penetrate the inner housing 11 in a longitudinal direction and are arranged parallel to each other in a lateral direction. Front portions of the cavities 12 (left side in FIGS. 3 and 4) define terminal housing spaces 13 for housing the terminal fittings 30. Rear portions of the cavities 12 define cylindrical sealing holes 14.

An outwardly projecting flange 15 is formed continuously around the outer periphery of the inner housing 11 at a position slightly behind the longitudinal center of the inner housing 11. Further, a waterproof seal ring 18 is mounted on the outer periphery of the inner housing 11 for sealing a gap between the outer periphery of the inner housing 11 and an inner periphery of a hood of a mating housing (not shown). The seal ring 18 is brought into contact with a front surface of the flange 15 to restrict rearward displacement of the seal ring 18. In the same manner, a ring-shaped elastic holding member 19 is mounted on the outer periphery of the inner housing 11 for holding the positional relationship between the inner and outer housings 11 and 20 in an initial state. The elastic holding member 19 is brought into contact with a rear surface of the flange 15 to restrict displacement of the elastic holding member 19 in the frontward direction.

Left and right engaging projections 16 project symmetrically from left and right outer side surfaces of the inner housing 11 at positions near the rear end of the inner housing 11. The engaging projections function to hold the inner and outer housings 11 and 20 in an assembled state. An arcuate projecting surface 17 is formed at a front surface of the engaging projection 16 and has a semicircular arcuate shape when viewed in the lateral direction. The centers of arcs of the left and right arcuate projecting surfaces 17 are arranged on the same axis.

The outer housing 20 has a block-shaped body 21 and a cylindrical fitting engagement portion 22 that extends frontward from the body 21.

Figure 5:
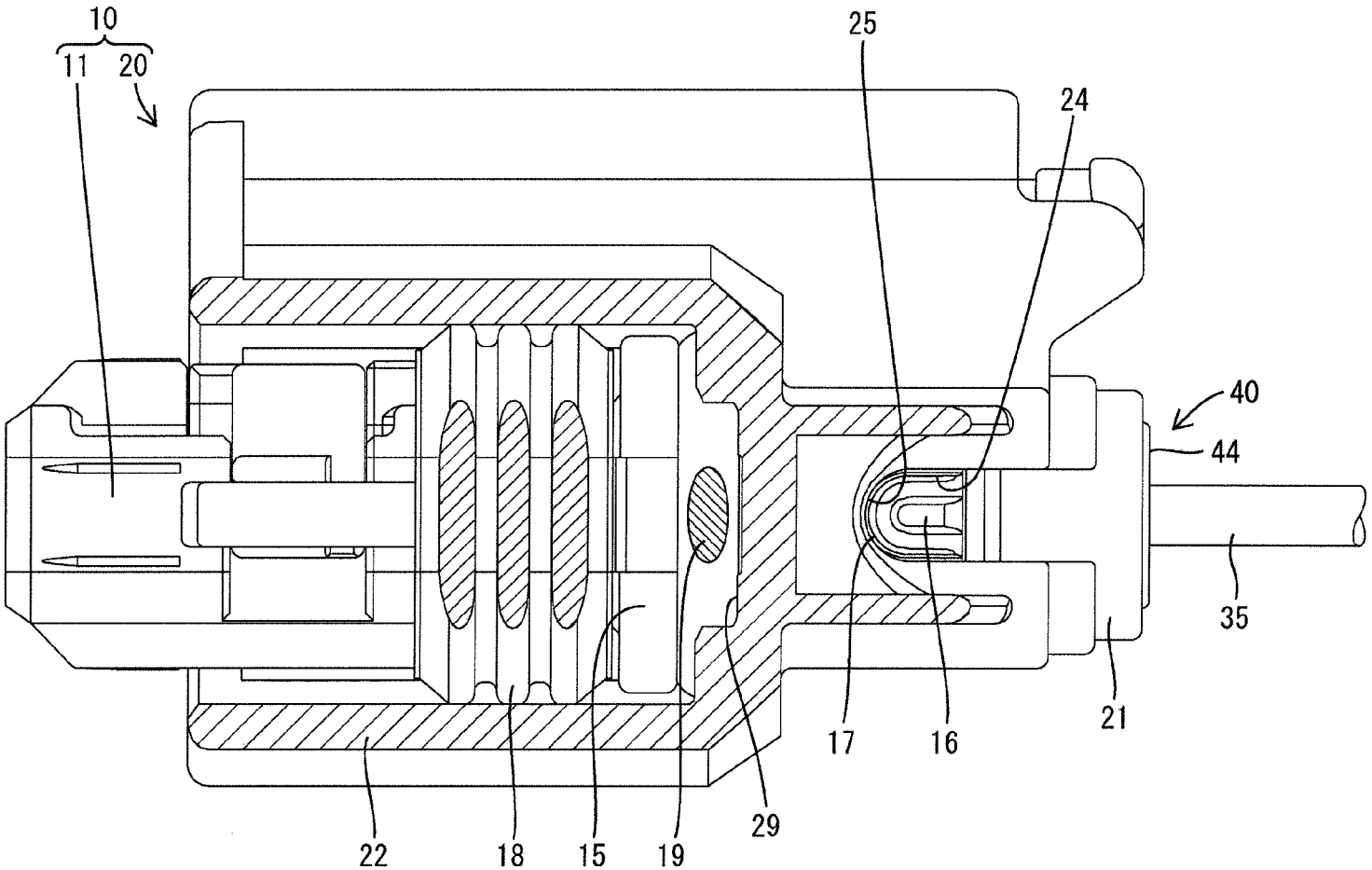
FIG. 5 is a cross-sectional view of the connector taken along a line X-X in FIG. 1.
Figure 6:
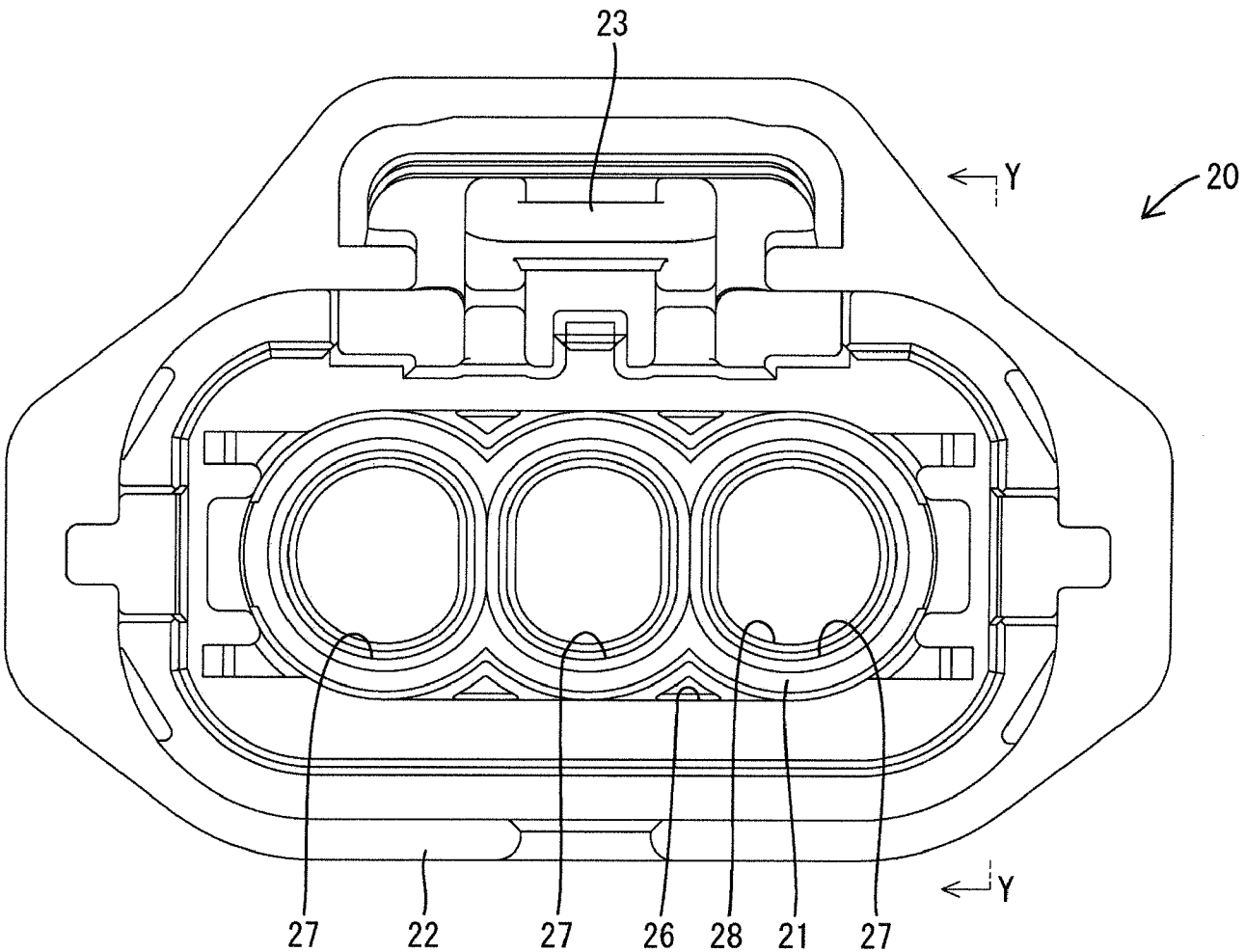
FIG. 6 is a front view of an outer housing (vibration attenuating member).
Figure 7:
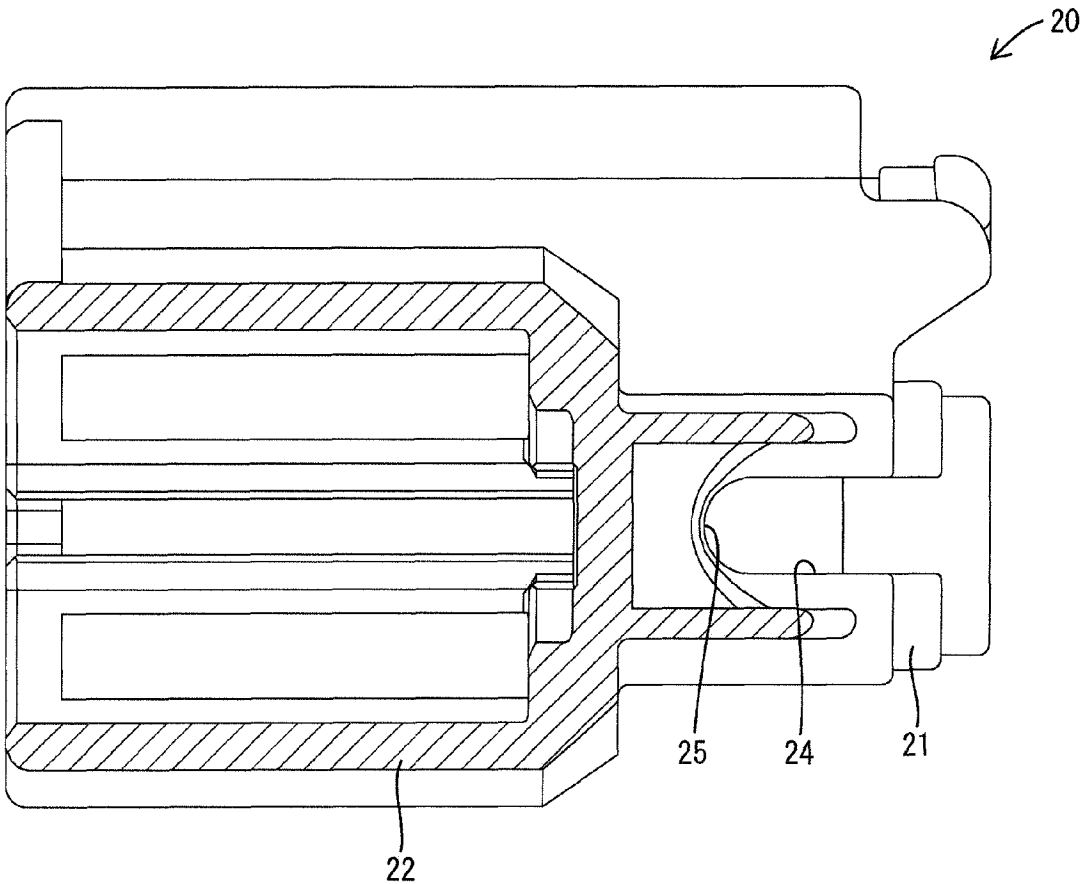
FIG. 7 is a cross-sectional view of the connector taken along a line Y-Y in FIG. 6.
Figure 8:
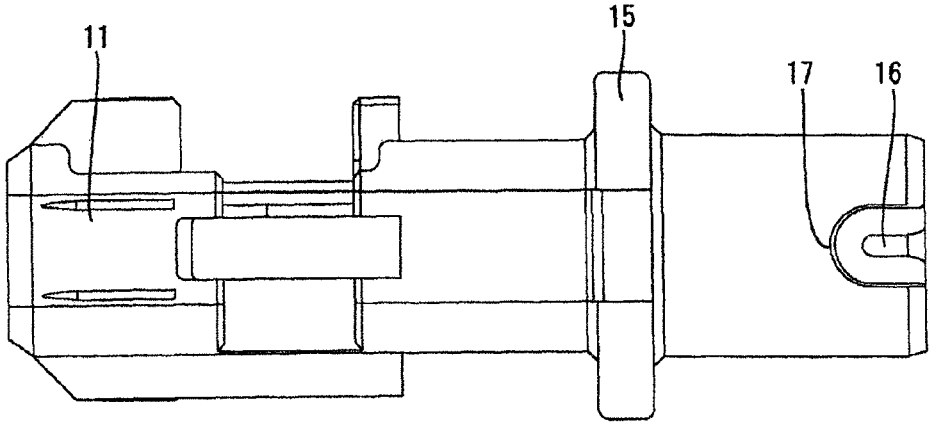
FIG. 8 is a side of an inner housing (terminal holding member).

A lock arm 23 is formed on the cylindrical fitting engagement portion 22 and extends in the frontward direction along an upper surface wall of the cylindrical fitting engagement portion 22. The lock arm 23 engages a lock projection (not shown) on the mating housing to hold the housing 10 and the mating housing in a fitting engagement state. Left and right engaging holes 24 symmetrically penetrate the left and right sides of the cylindrical fitting engagement portion 22, as shown in FIGS. 5 and 7, and function to hold the inner and outer housings 11 and 20 in an assembled state. Front edges of the engaging holes 24 form semicircular recessed surfaces 25 having the same radius of curvature as the arcuate projecting surfaces 17.

A front surface of the body 21 is indented to form a recess 22 that communicates with a rear end of a space formed in the cylindrical fitting engagement portion 22. A vertical size of the recess 26 exceeds a vertical size of a rear end portion of the inner housing 11, and a lateral size of the recessed portion 26 is equal to or slightly larger than a lateral size of the rear end portion of the inner housing 11. Three parallel holding holes 27 are arranged in the lateral direction of the body 21 and penetrate the body 21 from the recess 26 to the rear end surface of the body 21. The holding holes 27 are arranged at positions corresponding to the cavities 12 in the inner housing 11. Each holding hole 27 has a circular cross-sectional shape and a restriction 28 extends continuously around the inner peripheral surface of each holding hole 27 in the circumferential direction.

The inner and outer housings 11 and 20 are assembled so that the fitting engagement of the engaging projections 16 and the engaging holes 24 restricts a large displacement between the housings 11 and 20 in the longitudinal direction. A large displacement between the inner and outer housings 11 and 20 in the vertical direction also is restricted at positions where the engaging projections 16 engage the engaging holes 24. Further, the lateral sizes of the inner housing 11 and the recess 26 are substantially equal and hence, the relative displacement between the inner and outer housings 11 and 20 in the lateral direction is restricted.

Figure 3:
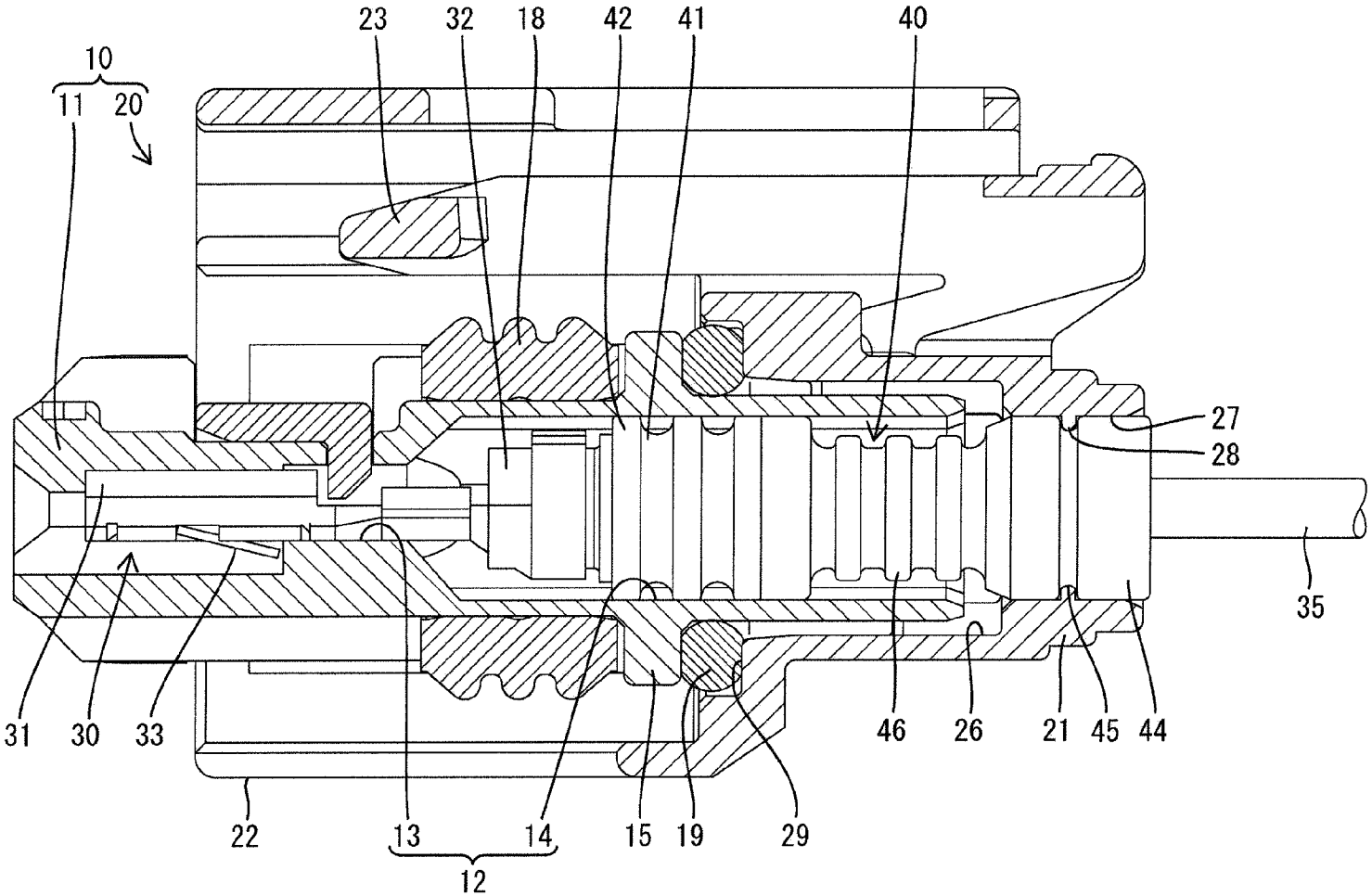
FIG. 3 is a cross-sectional view of the connector.
Figure 4:
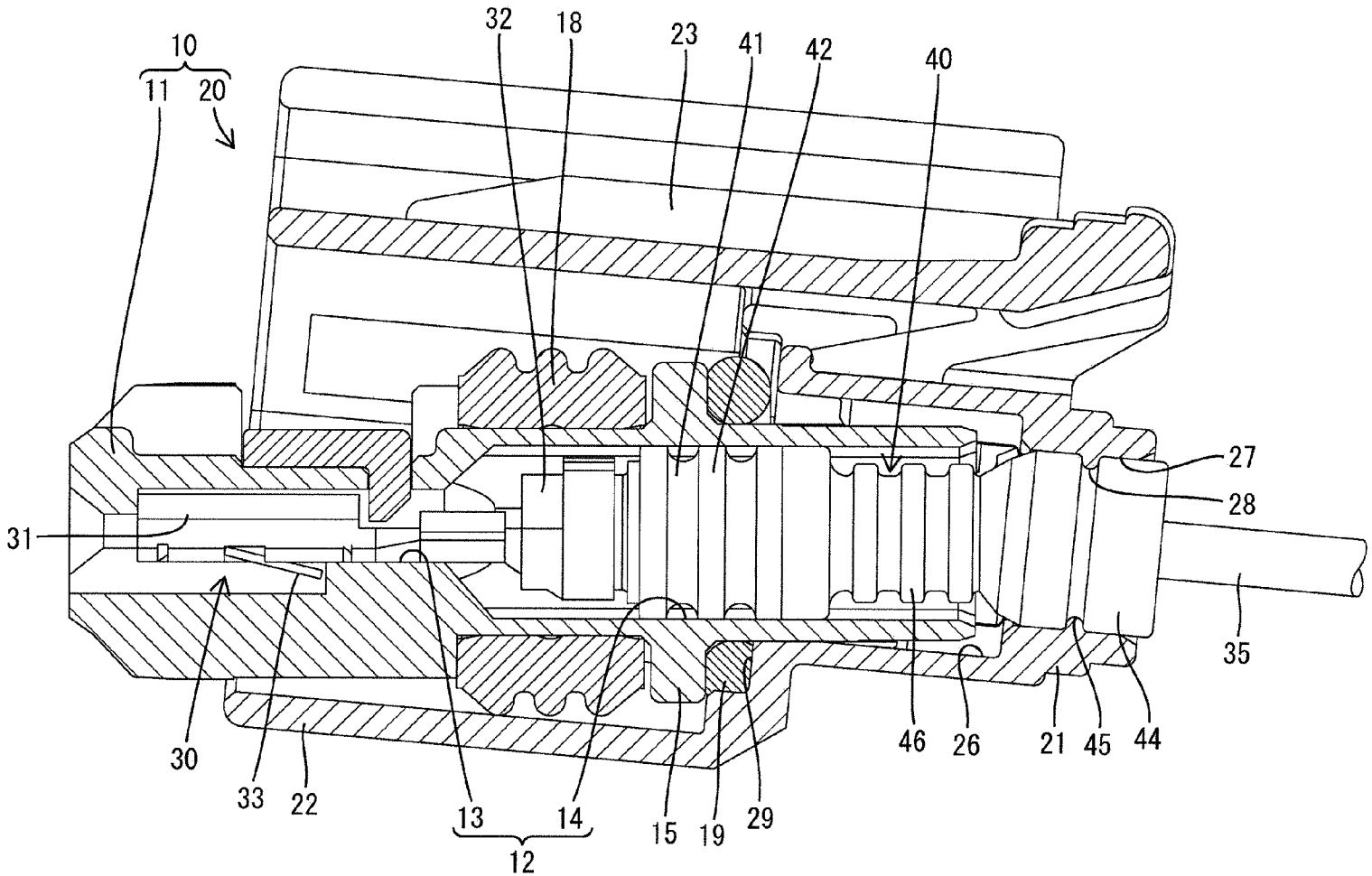
FIG. 4 is a cross-sectional view showing a state where vibrations are attenuated.

A portion of the inner housing 11 rearward of the elastic holding member 19 is in the recess 26 of the outer housing 20 and the holding holes 27 are behind the cavities 12 when the inner and outer housings 11 and 20 are in the assembled state shown in FIGS. 3 and 4. A region of the inner housing 11 in front of the recess 26 is surrounded by the cylindrical fitting engagement portion 22. Further, the elastic holding member 19 is sandwiched between a stopper 29 formed on an inner periphery of the cylindrical fitting engagement portion 22 along an opening edge of the recess 26 and a rear surface of the flange 15 in an elastically deformed state where the elastic holding member 19 is collapsed in the longitudinal direction. Further, an elastic restoring force of the elastic holding member 19 normally holds the inner and outer housings 11 and 20 in an initial state (see FIG. 3) where the sealing holes 14 of the cavities 12 and the holding holes 27 align substantially coaxially in the longitudinal direction.

The assembled inner and outer housings 11 and 20 can incline relative to each other about a laterally-extending imaginary axis that passes through the centers of arcs of the arcuate projecting surface 17 and the arcuate recessed surface 25 while bringing the arcuate projecting surfaces 17 and the arcuate recessed surfaces 25 into sliding contact with each other. Thus, front and rear ends of the inner and outer housings 11 and 20 can move vertically relative to one another in directions that intersect the longitudinal direction of the electric wire 35. A vertical size of the rear end portion of the inner housing 11 is smaller than a vertical size of the recess 26 and hence, there is no difficulty in the vertical inclination displacement of the inner and outer housings 11 and 20.

As shown in FIG. 3 and FIG. 4, the terminal fitting 30 is a female terminal that is elongated in the longitudinal direction. A quadrangular tubular terminal connecting portion 31 is formed at a front-end of the terminal fitting 30 and can receive a tab of a mating terminal (not shown) in the mating housing 10 so that the terminal connecting portion 31 and the tab are connected to each other in a conductive manner. Further, an electric wire connecting portion 32 is formed at rear-end of the terminal fitting 30. A front end portion of the electric wire 35 is connected to the electric wire connecting portion 32 in a conductive manner by compression bonding or crimping. A front end of the rubber plug 40 also is mounted on the electric wire connecting portion 32 together with the electric wire 35 by compression bonding or crimping.

The terminal fitting 30 is inserted from the rear through the holding hole 27 in the outer housing 20, through the sealing hole 14 of the cavity 12 and into the terminal housing space 13. The terminal fitting 30 that has been inserted correctly into the terminal housing space 13 is held in contact with a front surface of the cavity 12 so that the frontward movement of the terminal fitting 30 is prevented. Additionally, an engagement action of a lance 33 formed on the terminal connecting portion 31 prevents rearward removal of the terminal fitting 30. The electric wire 35 is led out to a position behind the inner housing 11 when the terminal fitting 30 is housed properly in the terminal housing space 13.

Figure 9:
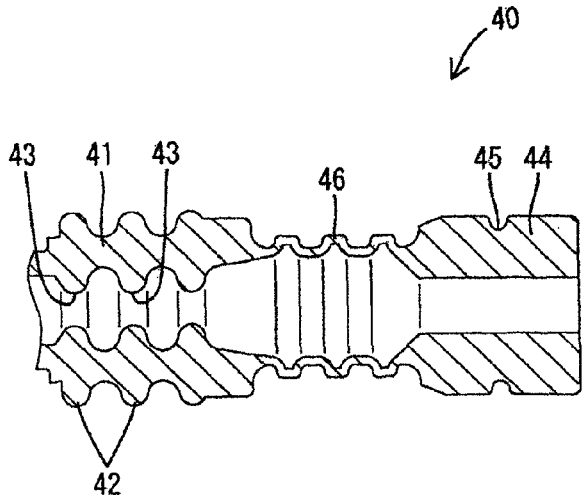
FIG. 9 is a cross-sectional view a rubber plug.

The rubber plug 40 is an elongated tube with an axis directed in the longitudinal direction, as shown in FIGS. 3, 4 and 9. As described above, the front part of the rubber plug 40 is mounted fixedly on the electric wire connecting portion 32 of the terminal fitting 30 together with the electric wire 35. Hence, the entire length of the rubber plug 40 is fit on the electric wire 35. The rubber plug 40 is formed unitarily and includes a sealing portion 41, a vibration reducing portion 44 and a vibration absorbing portion 46. The sealing portion 41 exhibits a waterproof function for sealing a gap between the inner periphery of the cavity 12 and an outer periphery of the electric wire 35. The vibration reducing portion 44 exhibits a vibration attenuating function for attenuating vibrations when the electric wire 35 vibrates. The vibration absorbing portion 46 is configured to connect a rear end of the sealing portion 41 and a front end of the vibration reducing portion 44 and exhibits a vibration absorbing function for absorbing vibrations when the electric wire 35 vibrates.

Parallel outer peripheral lips 42 extend circumferentially around an outer periphery of the sealing portion 41. An outer diameter of each outer peripheral lip 42 when the rubber plug 40 is not deformed elastically is slightly larger than an inner diameter of the sealing hole 14 of the inner housing 11. Further, parallel inner peripheral lips 43 extend circumferentially around an inner periphery of the sealing portion 41. An inner diameter of the inner peripheral lips 43 when the rubber plug 40 is not deformed elastically deformed is slightly smaller than an outer diameter of the electric wire 35. Accordingly, the inner peripheral lips 43 are brought hermetically into close contact with the outer periphery of the electric wire 35 in an elastically deflected state.

The vibration reducing portion 44 has a substantially cylindrical shape with substantially uniform inner and outer diameters along the length of the vibration reducing portion 44. The outer diameter of the vibration reducing portion 44 is equal to or slightly smaller than an inner diameter of the holding hole 27, and the inner diameter of the vibration reducing portion 44 is approximately equal to an outer diameter of the electric wire 35. A restricting groove 45 extends circumferentially around an outer periphery of the vibration reducing portion 44.

As shown in FIG. 9, the vibration absorbing portion 46 has a wall thickness smaller than a wall thickness of the vibration reducing portion 44 and has a bellows shape. The thin wall and the bellows configuration make the vibration absorbing portion 46 more easily elastically deformable in the longitudinal direction than the vibration reducing portion 44 and more easily elastically deformable so that an axis of the vibration absorbing portion 46 can be bent. A maximum outer diameter of the vibration absorbing portion 46 is less than a maximum outer diameter of the sealing portion 41, less than an inner diameter of the sealing hole 14 and less than an outer diameter of the vibration reducing portion 44. A minimum inner diameter of the vibration absorbing portion 46 is larger than an outer diameter of the electric wire 35. Further, a length of the vibration absorbing portion 46 in the longitudinal direction is approximately equal to the respective lengths of the sealing portion 41 and the vibration reducing portion 44 in the longitudinal direction.

The entire sealing portion 41 of the rubber plug 40 is in an approximately center region of the sealing hole 14 in the longitudinal direction when the inner and outer housings 11 and 20 are assembled together and when the terminal fitting 30 is inserted into the cavity 12. A front end portion of the rubber plug 40 is mounted fixedly on the terminal fitting 30. Thus, there is no possibility that the sealing portion 41 near the front end of the rubber plug 40 will be displaced significantly in the longitudinal direction of the sealing hole 14 when the terminal fitting 30 is inserted properly into the cavity 12. The outer peripheral lips 42 on the outer periphery of the sealing portion 41 are brought hermetically into close contact with the inner peripheral surface of the sealing hole 14 in an elastically deformed state.

The entire vibration absorbing portion 46 is in a rear part of the sealing hole 14 when the terminal fitting 30 is inserted properly into the cavity 12. Additionally, the vibration absorbing portion 46 is outside and forward of the holding hole 27. Further, the outer diameter of the vibration absorbing portion 46 is smaller than the inner diameter of the sealing hole 14 and hence a gap is formed between the outer periphery of the vibration absorbing portion 46 and the inner periphery of the sealing hole 14 over the circumference.

Approximately the entire vibration reducing portion 44 is inside the holding hole 27. Relative radial displacements of the vibration reducing portion 44 in the holding hole 27 radial direction (e.g. displacements in vertical and lateral directions that intersect the axis of the electric wire 35) are restricted. Accordingly, the vibration reducing portion 44 is displaceable integrally with the outer housing 20 and relative to the inner housing 11 in directions that intersect the longitudinal direction of the electric wire 35. Also, the engagement between the restricting projecting 28 and the restricting groove 45 inside the holding hole 27 restrict relative movement of the vibration reducing portion 44 in the longitudinal direction. As described above, the rubber plug 40 is positioned in the longitudinal direction relative to the housing 10.

When the electric wire 35 vibrates in the vertical direction, as shown in FIG. 4, the outer housing 20 and the vibration reducing portion 44 of the rubber plug 40 incline integrally relative to the inner housing 11, and the vibration energy of the electric wire 35 is attenuated by the relative displacement. The vibrations that are attenuated by the vibration reducing portion 44 and the outer housing 20 are transmitted from the vibration reducing portion 44 to the sealing portion 41 by way of the vibration absorbing portion 46. However, a part of the transmitted vibrations is absorbed by the vibration absorbing portion 46. The vibration absorbing portion 46 is outside the holding hole 27 and in front of the holding hole 27, which is a position where the vibration absorbing portion 46 is not brought into direct contact with the outer housing 20. Hence, the sealing portion 41 also is not brought into direct contact with the outer housing 20. Due to such a constitution, there is no possibility that the displacement of the outer housing 20 is transmitted directly to the sealing portion 41. Accordingly, the vibration absorbing portion 46 can sufficiently exhibit the vibration absorbing function and hence, the vibrations transmitted to the terminal fitting 30 from the electric wire 35 can be attenuated more effectively.

Further, the entire vibration absorbing portion 46 is in the cavity 12 so that the vibration absorbing portion 46 is protected from the outside. Hence, even if foreign material intrudes between the inner and outer housings 11 and 20, there is no possibility that the foreign material will interfere with the vibration absorbing portion 46.

The elastic deformation of the vibration absorbing portion 46 absorbs the vibrations. The outer diameter of the vibration absorbing portion 46 is smaller than the outer diameter of the sealing portion 41. Thus, the vibration absorbing portion 46 does not contact the inner peripheral surface of the cavity 12 and the inner periphery of the cavity 12 will not obstruct the vibrations of the vibration absorbing portion 46. As a result, the vibration absorbing portion 46 can exhibit a high vibration absorbing function. Further, the vibration absorbing portion 46 has a bellows shape and hence, the vibration absorbing portion 46 is easily elastically deformable, thereby contributing to the high vibration absorbing function of the vibration absorbing portion 46.

Further, the restricting projection 28 on the inner periphery of the holding hole 27 engages in the restricting groove 45 in the outer periphery of the vibration reducing portion 44 with a concave-convex fitting that restricts displacement of the vibration reducing portion 44 in the holding hole 27 along the longitudinal direction of the electric wire 35. Thus, the vibration reducing portion 44 is positioned accurately in the holding hole 27.

Further, a slight gap is formed between the outer peripheral surface of the vibration reducing portion 44 and the inner peripheral surface of the holding portion 27 and a slight gap is formed between the restricting projecting portion 28 and the restricting groove 45. Hence, even when water intrudes between the inner and outer housings 11 and 20, water can be discharged to a position behind the housing 10 (outside the housing 10) from the gap between the vibration reducing portion 44 and the holding portion 27.

The present invention is not limited to the embodiment explained in conjunction with the above-mentioned description and drawings, and also includes the following embodiments within a technical scope of the present invention.

In the above-mentioned embodiment, the engaging portion (lock arm) with which the mating housing is engaged is formed on the vibration attenuating member, and the vibration attenuating member also functions as the fitting member which is fit into the mating housing. However, the vibration attenuating member may be in no-contact with the counterpart housing thus constituting a dedicated member for vibration attenuation.

In the above-mentioned embodiment, at least a portion of the vibration absorbing portion is in the cavity. However, the whole vibration absorbing portion may be outside the cavity.

In the above-mentioned embodiment, the vibration absorbing portion has a bellows shape. However, the vibration absorbing portion may be a cylinder having a fixed outer diameter and a fixed inner diameter over the whole length thereof.

In the above-mentioned embodiment, the outer diameter of the vibration absorbing portion is smaller than the outer diameter of the sealing portion so that the vibration absorbing portion does not contact the inner peripheral surface of the cavity. However, at least a portion of the outer periphery of the vibration absorbing portion may contact the inner peripheral surface of the cavity when a vibration absorbing operation is being performed, or at least a portion of the outer periphery of the vibration absorbing portion may be brought into contact with the inner peripheral surface of the cavity when the vibration absorbing operation is not being performed.

In the above-mentioned embodiment, the displacement of the vibration reducing portion in the inside of the holding hole is restricted by concave-convex fitting between the restricting portions. However, the vibration reducing portion may be configured without such restricting portions so that the vibration reducing portion performs the relative displacement in the axial direction of the electric wire in the holding hole.

In the above-mentioned embodiment, the explanation is made by taking an example in which the present invention is applied to the female connector housing a female terminal fitting therein. However, the present invention is also applicable to a male connector that houses a male terminal fitting therein.

What is claimed is:

1. A connector comprising:

a housing having a terminal holding member with a cavity and a vibration attenuating member assembled to the terminal holding member in a displaceable manner, the vibration attenuating member having a holding hole arranged behind the cavity;

a terminal fitting mounted in the cavity of the terminal holding member;

an electric wire fixed to the terminal fitting and led out to a position behind the cavity and behind the holding hole; and a tubular rubber plug fit on the electric wire and having a sealing portion, a vibration reducing portion and a vibration absorbing portion, the sealing portion being fixedly mounted on a rear end portion of the terminal fitting and being hermetically in close contact with an inner peripheral surface of the cavity, the vibration reducing portion being fit in the holding hole and being displaceable with the vibration attenuating member, the vibration absorbing portion having a smaller thickness than the vibration reducing portion and connecting a rear end of the sealing portion and a front end of the vibration reducing portion to each other, the vibration absorbing portion arranged outside and in front of the holding hole.

2. The connector of claim 1, wherein the vibration absorbing portion has a bellows shape.

3. The connector of claim 1, wherein restrictions are formed on an inner periphery of the holding hole and an outer periphery of the vibration reducing portion and are configured to restrict the displacement of the vibration reducing portion relative to the holding hole in a longitudinal direction of the electric wire by concave-convex fitting.

4. The connector of claim 1, wherein at least a portion of the vibration absorbing portion is housed in the cavity.

5. The connector of claim 4, wherein the vibration absorbing portion has an outer diameter smaller than an outer diameter of the sealing portion so that the vibration absorbing portion does contact an inner peripheral surface of the cavity.

6. A connector comprising:

an inner housing with a cavity;

an outer housing assembled displaceably to the inner housing and having a holding hole behind the cavity;

a terminal fitting mounted in the cavity of the inner housing;

an electric wire fixed to the terminal fitting and led out to a position behind the cavity and behind the holding hole; and a tubular rubber plug fit on the electric wire and having a sealing portion, a vibration reducing portion and a vibration absorbing portion, the sealing portion being mounted fixedly on a rear portion of the terminal fitting and being in close contact with an inner peripheral surface of the cavity, the vibration reducing portion being fit in the holding hole and being displaceable with the outer housing, the vibration absorbing portion extending between the sealing portion and the vibration reducing portion and having a smaller thickness than the vibration reducing portion, the vibration absorbing portion being arranged outside of and in front of the holding hole.

7. The connector of claim 6, wherein the vibration absorbing portion has a bellows shape.

8. The connector of claim 6, wherein a restricting projection on an inner periphery of the holding hole engages a restricting groove formed on an outer periphery of the vibration reducing portion to restrict displacement of the vibration reducing portion relative to the holding hole in a longitudinal direction of the electric wire.

9. The connector of claim 6, wherein the inner and outer housings are pivotable relative to one another about an axis transverse to a longitudinal direction of the electric wire.

10. The connector of claim 6, wherein at least a portion of the vibration absorbing portion is in the cavity.

11. The connector of claim 10, wherein the vibration absorbing portion has an outer diameter smaller than an outer diameter of the sealing portion so that the vibration absorbing portion does contact an inner peripheral surface of the cavity (12).

* * * * *